US006139444A

United States Patent [19]

Renard et al.

[11] Patent Number: 6,139,444

[45] Date of Patent: Oct. 31, 2000

[54] GOLF SHAFT AND METHOD OF MANUFACTURING THE SAME

[75] Inventors: Philippe Renard, La Balme, France; Todd Beach, San Diego; Eric Zedelmayer, Encinitas, both of Calif.

[73] Assignee: Taylor Made Golf Company, Inc., Carlsbad, Calif.

[21] Appl. No.: 08/979,459

[22] Filed: Nov. 26, 1997

[51] Int. Cl.[7] ..... A63B 53/10; A63B 53/12

[52] U.S. Cl. ..... 473/320; 273/DIG. 7; 273/DIG. 23

[58] Field of Search ..... 473/316, 317, 473/318, 319–323, 308–310; 273/DIG. 7, DIG. 23

[56] References Cited

U.S. PATENT DOCUMENTS

| | | | |
|---|---|---|---|
| 2,809,144 | 10/1957 | Grimes . | |
| 2,991,080 | 7/1961 | Redmond . | |
| 4,023,802 | 5/1977 | Jepson | 473/309 |
| 4,455,022 | 6/1984 | Wright | 473/318 |
| 4,757,997 | 7/1988 | Roy | 473/319 |
| 4,836,545 | 6/1989 | Pompa . | |
| 5,028,464 | 7/1991 | Shigetoh . | |
| 5,083,780 | 1/1992 | Walton | 473/320 |
| 5,253,867 | 10/1993 | Gafner . | |
| 5,255,914 | 10/1993 | Schoder | 473/309 |
| 5,429,358 | 7/1995 | Rigal et al. . | |
| 5,665,441 | 9/1997 | Suzue et al. . | |
| 5,686,155 | 11/1997 | Suzue et al. . | |
| 5,716,291 | 2/1998 | Morell et al. . | |
| 5,759,112 | 6/1998 | Morell et al. . | |
| 5,943,758 | 8/1999 | Haas | 473/318 |

FOREIGN PATENT DOCUMENTS

| | | |
|---|---|---|
| S51-8039 | 1/1976 | Japan . |
| 07059884 | 7/1995 | Japan . |
| 07116289 | 9/1995 | Japan . |
| UM 2529041 | 12/1996 | Japan . |
| 2313321 | 11/1997 | United Kingdom . |

*Primary Examiner*—Jeanette Chapman
*Assistant Examiner*—Stephen L. Blau
*Attorney, Agent, or Firm*—Knobbe, Martens, Olson & Bear, LLP

[57] ABSTRACT

A golf club shaft having a hollow body comprised of a fiber and resin composite and a tube-shaped stiffener substantially surrounding a lower portion of the body which comprises a material other than a fiber and resin composite. The stiffener is preferably a metal and comprises a pre-formed sheath.

19 Claims, 7 Drawing Sheets

GOLF SHAFT AND METHOD OF MANUFACTURING THE SAME

FIELD OF THE INVENTION

The present invention relates to a golf club shaft and, more particularly, a lightweight composite shaft and a method of manufacturing the same.

DESCRIPTION OF RELATED ART AND SUMMARY OF THE INVENTION

Golfers, anxious to improve their games, have embraced golf clubs having shafts with enhanced performance characteristics. The preferred golf club shafts are manufactured of composite materials. Composite materials are desirable in that they can be made extremely lightweight and conform to desired flexional characteristics. Current efforts have focused on reducing the weight of the shaft, while maintaining these characteristics. Unfortunately, lightweight fiber and resin-based shafts are more likely to break at the tip area and provide less torsional strength than metal shafts.

In general, the bending strength of the composite shaft can be precisely controlled by the use of longitudinally oriented fibers, while torsional strength can be controlled through fibers offset from the shaft axis plus or minus 45 degrees. Torsional stiffness is important in that it influences head rotation during ball impact. If the torsional stiffness is too low, the head will have a tendency to rotate causing the ball to rebound off the club face at an incorrect angle and with reduced initial velocity. While it is possible to provide a composite shaft having the same torsional stiffness as a metal shaft, such torsional stability can only be achieved if a relatively high number of plus/minus 45 degree fibers is added to the structure. These additional plus/minus 45 degree fibers are particularly required in the tip area of the shaft, which experiences great torsional stress. Unfortunately, these fibers add bulk and weight in a particularly undesirable location.

Nonetheless, composite shafts are preferred by most golfers because they are light weight and have a more pleasant "feel" at impact than metal shafts. Composite shafts are also less sensitive to resonance phenomena.

Efforts have been made to develop a two-piece golf club shaft that combines the benefits of metal shafts and fiber/resin composite shafts. For example, U.S. Pat. No. 4,836,545 to Pompa discloses a two-piece shaft including a lower metal tip section having a plurality of expanding steps which extends approximately 0.25 to 0.45 of the total shaft length. The shaft is provided with an upper composite butt section which is fitted into and bonded to the inside wall of the last step of the metal section for approximately 1.50 inches.

Unfortunately, this design has a number of drawbacks. Specifically, with the lower part being metal and the upper part being a fiber/resin composite, it is likely that the lower part and the upper part of the shaft will flex in a very different manner. This difference of behavior in a single shaft is undesirable. Further, as a result of this difference in flex, a localized region of high stress at the junction between the upper and lower part of the shaft is likely to occur. The use of a metal tip portion will also increase the weight of the club over a composite shaft, and will tend to transmit vibrations to the grip portion of the shaft, providing a less desirable feel. Finally, the use of metal at one end and composite at the opposite end makes it more complex to balance the club due to the difference in density of the materials.

U.S. Pat. No. 5,253,867 to Gafner discloses another golf shaft formed of metal portion and a composite portion, with the metal portion and composite portion meeting at the middle point along the shaft, and the composite portion being located near the grip. As discussed above in connection with Pompa, this approach tends to result in an undesirably large variation in the bending behavior of the shaft along its length and produce an area of stress concentration at the junction of the two portions of the shaft.

Another golf club shaft is disclosed in U.S. Pat. No. 2,809,144 to Grimes. Grimes discloses a method of making a golf club shaft from a hollow metal insert which is less than the desired length of the shaft and a thermosetting resin impregnated glass fabric cloth. A mandrel is attached to the metal insert at one end to provide an overall length equivalent to the desired shaft length. The insert is then coated with an adhesive and layers of cloth are wrapped around the insert and the mandrel. A thermal shrinkable cellophane tape is used to exert pressure on the composite material to squeeze the plastic material onto the metal insert when the tape is feeded during the curing cycle.

Unfortunately, to provide the sufficient strength, the inner metal insert must be relatively thick, and therefore heavy. Further, it is undesirable to have a shaft with exposed resin and fiber composite in the tip region. Specifically, changing shafts with a fiber tip portion engaged in a metal head hosel is very problematic. The heating of the embedded portion of the shaft can cause irreparable damage to the shaft. Further, the tip portion of the shaft can be damaged by abrasion during storage in a golf bag.

U.S. Pat. No. 2,991,080 discloses yet another golf club shaft. Redman discloses the use of a tubular metal core covered with an outer casing of resin impregnated glass fibers. The tubular core extends the entire length of the shaft. Unfortunately, the use of a metal core extending the entire length of the shaft does not provide optimal flexion, weight, or resistance to external abrasion.

Yet another golf shaft is disclosed in Japanese Application (A 51-8039) to Kobayashi. Kobayashi discloses golf shaft having a metallic layer spaced apart from the tip end of the shaft which extends approximately one-quarter to one-half of the shaft length.

Japanese Utility Model (Y2) 2,529,041 to Minami discloses a golf club shaft having a portion spaced 200 to 600 millimeters from the butt end of the shaft which is made of a laminated composite formed from a fiber reinforced synthetic resin layer and a metal layer, with the rest of the shaft being made of an all-fiber reinforced synthetic resin.

There remains a need, however, for an improved golf club shaft which is lightweight and provides the improved feel and resistance to resonance phenomena of fiber/resin composite shafts, while providing increased resistance to torsion and breakage.

An important aspect of the invention is a golf club shaft having a butt end, a tip end, and a median point. The shaft has a hollow body comprised of a fiber and resin composite extending substantially the length of the shaft from the butt end to the tip end. A tube-shaped stiffener substantially surrounds a lower portion of the body and comprises a material other than a fiber and resin composite. The stiffener includes a lower end positioned substantially at the tip end of the body and an upper end positioned below the median point of the shaft. Preferably, the stiffener has a greater torsional strength per unit of weight than the rest of the composite body in the lower portion of the body. Desirably, the material of the stiffener comprises a metal. Preferably, the stiffener comprises a pre-formed sheath.

The shaft desirably has a generally tapering body, having a larger butt end and a smaller tip end. Preferably, the portion of the hollow body above the upper end of the member is substantially free to flex.

Significantly, the aforementioned shaft is particularly adapted to have a higher resistance to torque than an all fiber/resin shaft, yet is still relatively light and provides the desired pleasant feel upon striking. Importantly, the shaft is also more resistant to breakage in the tip area than an all fiber/resin shaft. At the same time, however, the shaft tends to flex in a manner very similar to an all fiber/resin shaft and has no abrupt discontinuities of bending behavior along its length. Yet another advantage of the aforementioned shaft is that it avoids zones of stress concentration, which would pose a higher risk of breaking. The tip of the shaft has a superior abrasive resistance and is more resistant to shock at its tip than a pure fiber/resin shaft. Furthermore, the stiffener being located on the outside of the shaft increases the hoop strength of the tip end which helps prevent longitudinal cracks and delamination of the fiber and resin structure underneath.

Yet another advantage of the foregoing shaft is that the shaft can be easily removed from a golf club head without being damaged. The shaft can also perform the function of the hosel so that it can be fitted with golf club heads which do not incorporate a separate hosel. Yet another aspect of the invention is a golf club, including the aforedescribed shaft, including a head and a grip.

Another aspect of the invention is a method for manufacturing a shaft comprising a fiber and resin-based hollow body and at least one tube-shaped stiffener located externally along a pre-determined portion of the fiber and resin-based hollow body. The method desirably includes the steps of: (1) positioning a bladder made of stretchable and impervious material on an elongated mandrel; (2) covering the mandrel with fibers impregnated with a resin so as to obtain an elongated wound fibrous complex; (3) fitting the elongated complex within the tube-shaped stiffener; (4) positioning the stiffener in a predetermined position along the elongated complex; (5) positioning the elongated complex and tubular member in a mold cavity which substantially defines the final shape of the shaft; and (6) heating the mold and applying pressurized fluid inside the bladder to force one portion of the complex against the inner surface of the stiffener and the remainder of the complex against the wall of the mold.

While this method is particularly advantageous in manufacturing the shaft described above, it can also be used in connection with the manufacture of different types of shafts. This process facilitates proper bonding and integration of the stiffener to the rest of the shaft, without the need for a separate adhesive or an adhesive bonding step. Additionally, this method facilitates the precise longitudinal positioning of the stiffener along the shaft length. Yet another advantage of the aforementioned method, is that molds presently adapted to manufacture all fiber/composite shafts can be utilized in the manufacturing process, with a minimum or no mold modification.

Advantageously, the method also includes: (a) maintaining a space between the external surface of the complex and the mold cavity in the region not covered by the stiffener, while having the external surface of the stiffener positioned in direct contact with the mold wall; and (b) radially displacing the complex in the region not covered by the stiffener until the external surface of the complex forms a continuous external surface with the external surface of the stiffener.

BRIEF DESCRIPTION OF THE DRAWINGS

The characteristics and advantages of the invention will be better understood through the description which follows, with reference being made to the accompanying drawings, illustrating various preferred embodiments of the invention, and in which:

FIG. 8 illustrates the positioning of the mandrel within the mold;

FIG. 9 is a cross-sectional view along 9—9 of FIG. 8;

FIG. 10 is an enlarged cross-sectional view of the mandrel within the mold prior to pressurization;

FIG. 11 is an enlarged cross-sectional view illustrating the connection between the body and the stiffener after pressurization;

DETAILED DESCRIPTION OF THE PREFERRED EMBODIMENT

Figure 1:
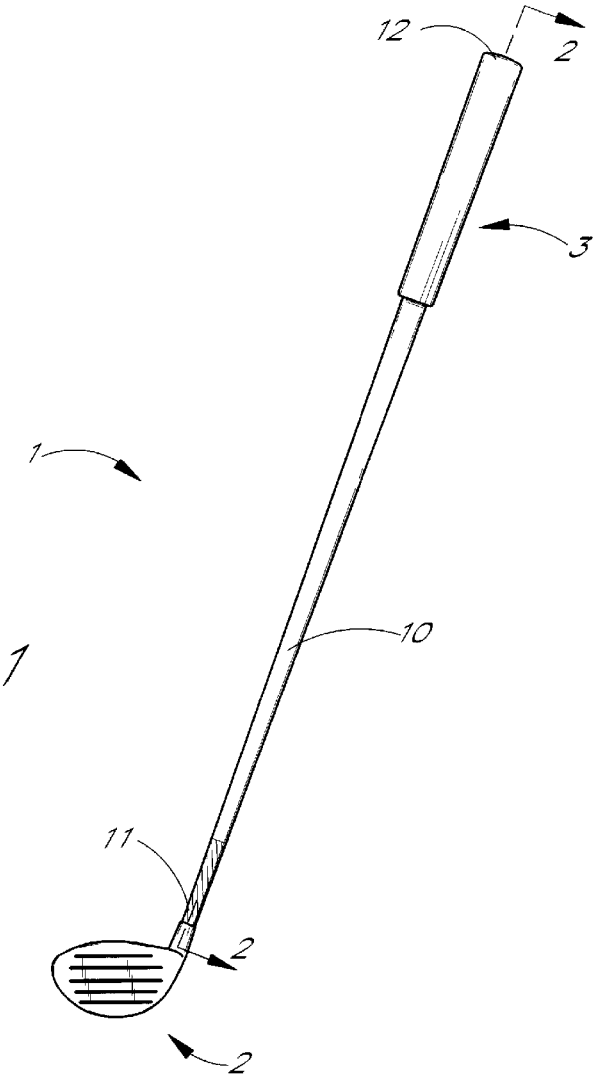
FIG. 1 is a elevational view of the golf club shaft of the present invention.

Referring to FIG. 1, there is shown a golf club 1 having an elongated shaft 10. The shaft has a tip end 11 and butt end 12. A club head 2 is secured to the tip end 11 of the shaft and a grip covers a grip portion of the shaft at the butt end 12.

Figure 2:
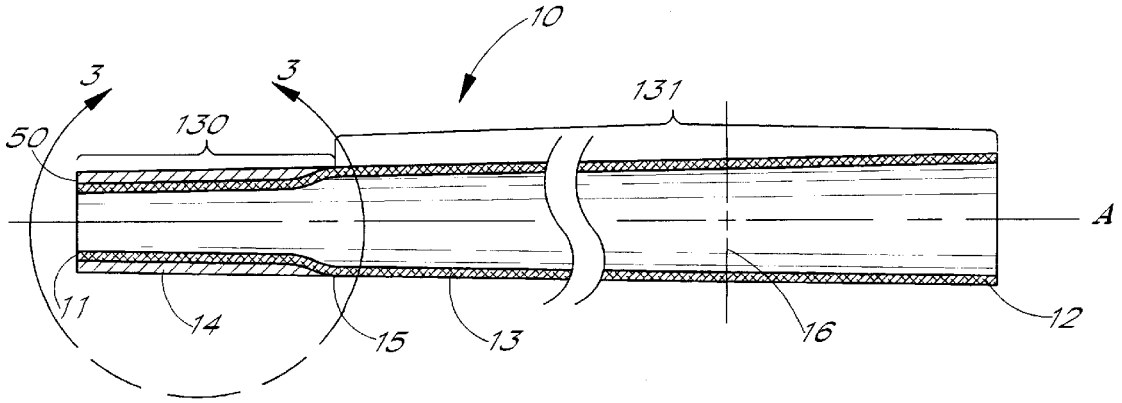
FIG. 2 is a longitudinal cross-sectional view along line 2—2 of the shaft of FIG. 1.

Referring now to FIG. 2, the shaft 10 defines a longitudinal axis A and has a generally tapered cross-section with the butt end 12 being larger and the tip end 11 being smaller. The shaft is substantially comprised of two different components. One component is a fiber and resin-base hollow body 13 which extends the entire length of the shaft from the butt end 12 to the tip end 11. Preferably, the body includes fibers chosen from the following group: carbon-graphite, fiberglass, aramid and combinations thereof. The other part is a stiffening tube 14 made of a high modulus isotropic material and, preferably, a metallic material. The tube 14 covers a lower portion 130 of the hollow body 13. The portion 131 of the body 13 not covered by the tube 14 is a free portion 131 (i.e., it is a portion which is substantially free to flex solely in accordance with the characteristics of the fiber and resin base body). The tube 14 has a lower end 50 which is co-extensive with the tip end 11 of the hollow body 13. The tube 14 has an upper end 15, which terminates well below the median point of the shaft. The tube 14 and the body 13 are advantageously joined along the entire length of the tube, so that the stresses are not concentrated along a short overlapping portion or shoulder.

Preferably, the tube is a solid piece of metallic material having isotropic properties (i.e., mechanical properties which are equal regardless of the direction in which force is applied). Preferably, the tubular member comprises one of the following groups of materials: steel, aluminum, titanium, copper, zinc, alloys of these materials, and metal matrix composites. Metal matrix composites desirable for use in connection with the present invention will generally be quasi-isotropic materials.

Desirably, the length of the lower tube 14 is approximately 0.05–0.45 and preferably 0.10–0.25 of the total shaft length, so that the tube influences the overall weight and balance of the shaft as little as possible, while still conferring its intended benefits.

Advantageously, the tube 14 is positioned to increase the torque resistance of the fiber/resin hollow body 13 in the area adjacent the tip end 11 of the shaft 10. This reinforcement of the tip area prevents the club head from rotating around the shaft axis during impact, thereby preventing the ball from being struck at an improper angle. As will likewise be appreciated, the tube 14 also improves the resistance of the shaft to breakage in the tip area.

In addition, the shaft should also reduce mishits through the reduction of the "droop" effect. Specifically, the use of an oversized head, with both woods and irons, is typically accompanied by displacement of the center of gravity away from the shaft axis. This shifting of the center of the gravity causes head to droop during swinging, due to the centrifugal force acting through the center of gravity of the club head during the swing. This force creates a bending moment on the tip of the shaft, which causes the club head to droop downward so that the toe of the club face will be lower than the heel at the time of impact with the ball. This can have two undesirable consequences. First, the misaligned club head can strike the ground prior to hitting the ball. Second, the leading edge of the club, rather than the impact face, can strike the ball. Importantly, however, the shaft 10 of the present invention reduces the droop effect by increasing the flexional rigidity of the lower portion of the shaft.

Figure 3:
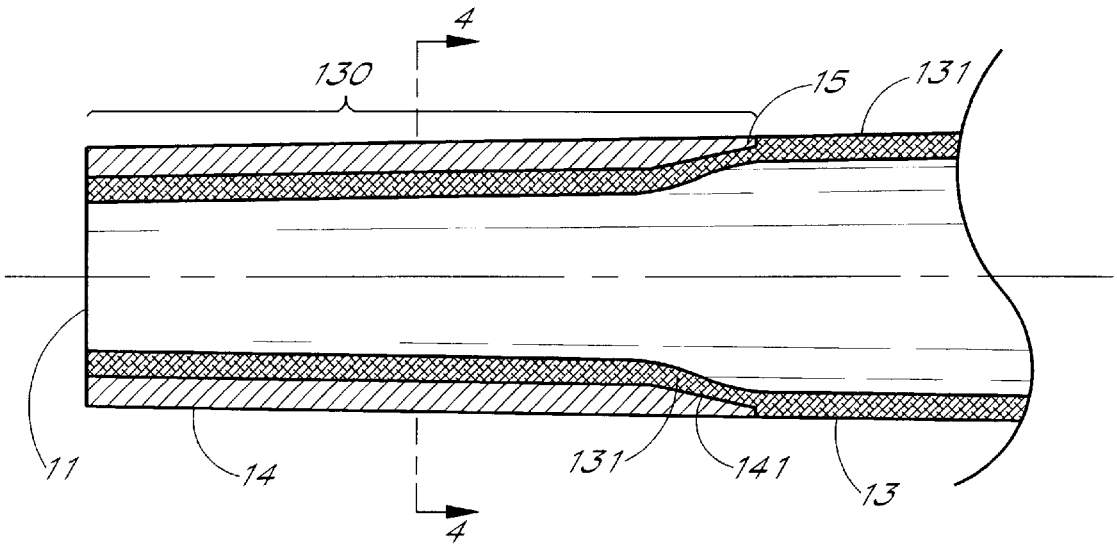
FIG. 3 is an enlarged cross-sectional view of the tip area of the shaft of FIG. 1.

Referring now to FIG. 3, the upper end 15 and the outer surface of the tube 14 cooperate with the outer surface of the body 13 to form a continuous surface. That is, there is neither a longitudinal gap between the upper end 15 of the tube 14 and the outer surface of the body, nor a radial discontinuity between the exterior surface of the tube and the exterior surface of the body. This permits the club shaft to have an exterior profile consistent with pure fiber/resin club shafts, as is preferred aesthetically by many players.

Significantly, the positioning of the tube 14 external of the body 13 increases the diameter of the tube 14 and, therefore, the tube's resistance to torque. Additionally, as will be discussed below in detail, the positioning of the tube outside of the body 13 facilitates the manufacture of the shaft 10.

Desirably, the upper portion of the tube 14 includes an outwardly tapering or flared portion 141 providing a more gradual change in internal diameter. This permits the lower portion of the body 13 to also define a more gradual internally-tapered outer surface 131 which mates with the outwardly tapered inner surface of the tube 14. This construction reduces stress concentrations in the upper end of the tube 14 and the body 13, along the mating surfaces. This reduces the risk of breakage of the shaft along this upper line. In addition, the ramp-shaped termination of the tube 14 prevents the fibers of the body from being bent at abrupt angles, which would render them more fragile.

Advantageously, the tube 14 has a cylindrical lower section adjacent its lower end 50, which corresponds in size and shape to the opening in most golf club heads. The cylindrical section permits the same shaft to be used in connection with different golf club heads within a single set, just by cutting the cylindrical section, to adjust the length of the shaft. Because this has no impact on the outer diameter of the cylindrical section, the connection to the club head is not negatively impacted.

It will be appreciated, however, that the shape of the lower section of the tube may also comprise shapes other than a cylinder. Specifically, the lower section could be tapered or have a bulged configuration. Additionally, the tube 14 could also be formed of many cylindrical portions having different increments separated by steps to permit more precise adjustment of the stiffness distribution of the lower half of the shaft.

It will also be appreciated, that the tube could also be made with a larger exterior diameter, for use with very large heads, to provide enhanced stability and control.

Figure 4:
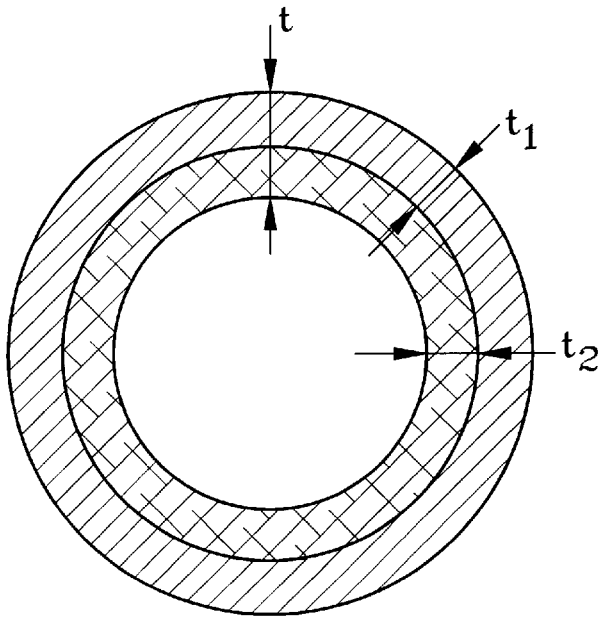
FIG. 4 is a cross-sectional view along 4—4 of FIG. 3.

Importantly, however, the amount the shaft 10 weighs in excess of a standard all fiber/resin shaft can be minimized by minimizing the wall thickness of the member 14. Referring to FIG. 4, $T_1$ represents the thickness of the tube 14, $T_2$ represents the thickness of the lower portion 130 of the body 13 and T represents the total thickness of the wall of the shaft 10. Advantageously, the thicknesses are as follows:

- 0.005 inches is less than or equal to $T_1$ which is less than or equal to 0.1 inches;
- 0.01 inches is less than or equal to $T_2$ which is less than or equal to 0.13 inches; and
- 0.015 inches is less than or equal to T which is less than or equal to 0.15 inches.

Significantly, the thickness of the tube $T_1$ compliments the thickness of $T_2$ of the fiber and resin-based body, so that the parts together provide sufficient resistance to torque, and resistance to breakage. Because the shaft utilizes the strength of the fiber and resin-based hollow body 13, as well as the strength of the tube 14, the thickness of the tube 14 can be reduced. This facilitates the proper balancing of the shaft and allows the shaft to more closely replicate the bending behavior of an all fiber and resin-based shaft. Additionally, the shaft also experiences some improvement in bending stiffness at the tip area, which should reduce the droop effect, thereby providing for greater control of the trajectory of the ball and stronger hits.

Figure 5:
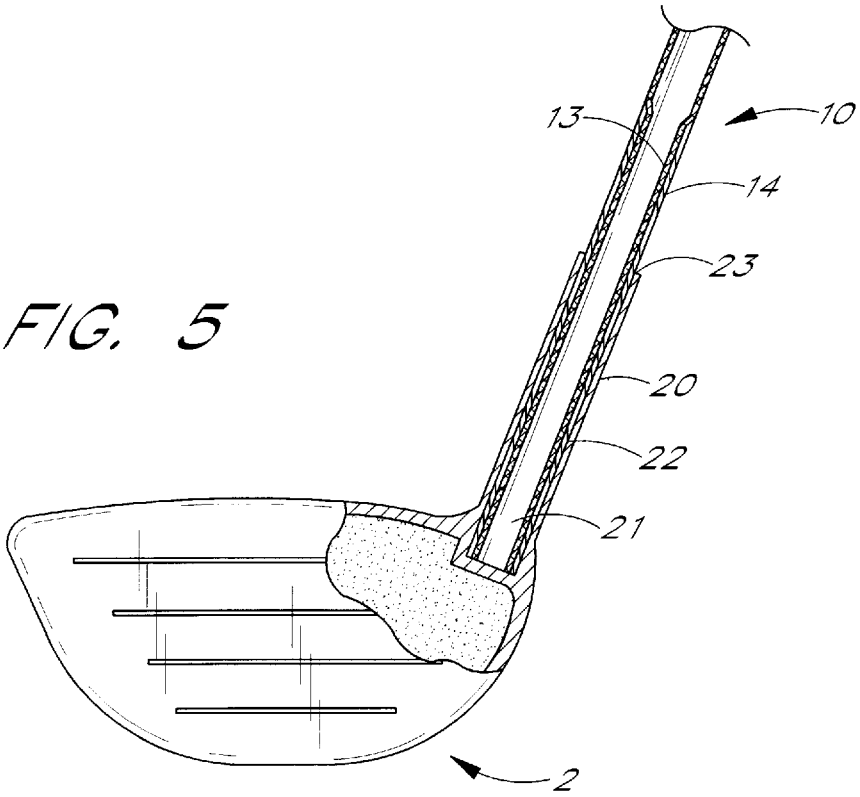
FIG. 5 is an enlarged partially cut-away view illustrating the junction of the golf club shaft with the head of a golf club including a hosel.

Referring now to FIG. 5, the tip end 11 of the shaft is positioned within a hole 21 in the golf club head 2. Proximate the tip end of the shaft, the lower section of the tube 14 defines the exterior surface of the shaft. The interior surface of the head defining the hole 21 is formed by a neck or hosel 20, extending upwardly from the head body. Desirably, the tube 14 is at least slightly longer than the embedded portion of the shaft, so that the tube 14 extends beyond the upper end 23 of the hosel 20 to reduce the risk of breakage. Preferably, the member extends 5 inches above the upper end 23 of the hosel 20.

A layer 22 of adhesive is provided between the exterior surface of the tube and the inner surface forming the hole 21 of the hosel 20 to secure the area proximate the tip end of the shaft 10 in the hole 20 formed by the hosel. Importantly, the use of a metallic tube is particularly adapted to permit the easy disassembly of the shaft, if the head 2 has to be removed for various reasons. That is, the head 2 can be heated until the adhesive bond between the head 2 and the tube 14 is weakened so that the head can be removed. Importantly, because the metallic tube 14 is located around the outside of the fiber and resin body, the metal tube 14 protects the fiber/resin body 13 from damage from heat, in part by acting as a heat sink.

Figure 6:
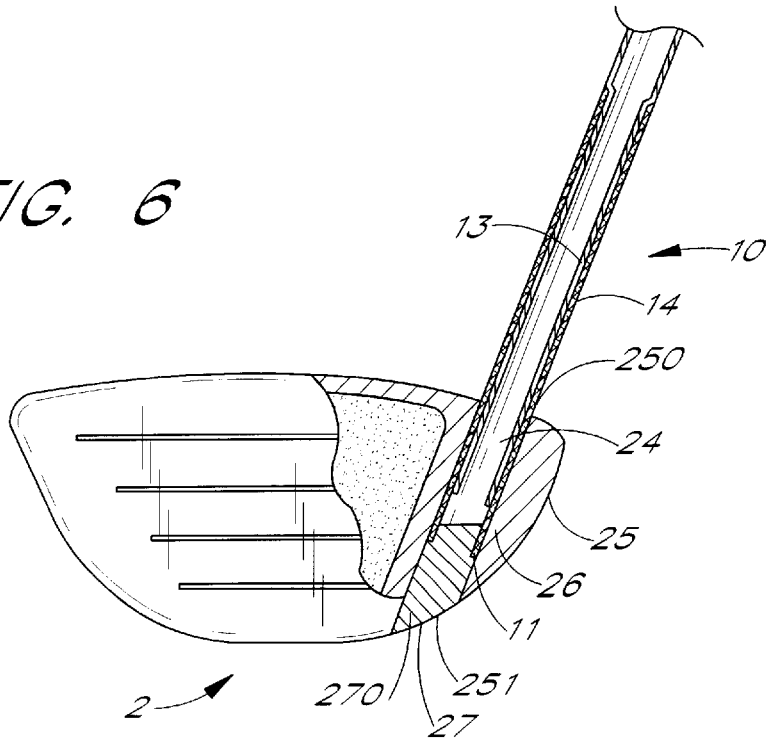
FIG. 6 is an enlarged partially cut-away view illustrating the junction of the shaft with a golf club head having no hosel.

Referring to FIG. 6, an alternative golf club incorporating the shaft 10 of the present invention is illustrated. The illustrated head 2' defines an embedding hole 24 extending through the heel 25 of the head 2' from the top 250 to the bottom 251 of the heel and is adapted to receive the tip end 11 of the shaft. When the shaft is to be used as part of a golf club without a hosel, the tube 14 should extend upwardly beyond the top 250 of the head a length sufficient to resist torque and breakage. Desirably, the distance of extension of the tube beyond the top 250 comprises at least 5 inches.

This arrangement may be desirable, in that the head can be lightened and/or the center of gravity may be lowered with respect to a conventional head, while still providing sufficient resistance to torque and breakage at the junction of the head and shaft. Again, an adhesive layer 26 is provided between the outer surface of the embedded portion of the tube 14 and the inner surface of the golf club head 2' defining the opening 24. For example, an epoxy layer could be used. A plug 27 can be positioned in the opening 24 opposite the end through which the shaft tip 11 is inserted. Preferably, the tip end 11 of the shaft abuts a peripheral shoulder 270 of the plug 27 to precisely position tip end 11 of the shaft and, therefore, the tube 14 and to control the amount of the tube 14 which extends within the club head 2'.

FIGS. 7–11 illustrate a preferred method of manufacturing the shaft 10. On the other hand, it will be appreciated that the disclosed method may also be advantageous in manufacturing other types of golf club shafts.

Figure 7:
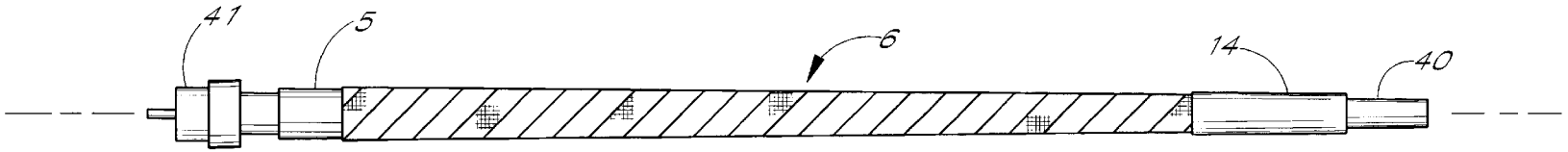
FIGS. 7–11 illustrate a method for manufacturing the golf club shaft of the present invention, with FIG. 7 illustrating the laying up of the bladder on the mandrel.

Referring to FIG. 7, a mandrel 4 is provided, which has a length slightly greater than that of the shaft to be produced. The mandrel has a substantially tapered shape or profile, with a first end 40 having a larger cross-section and a second opposing end 41 having a smaller cross-section. Desirably, the diameter of the mandrel uniformly decreases in size from the first end 40 to the second end 41.

The mandrel 4 is covered with a bladder 5 made out of a stretchable and impervious material, such as rubber. It has been determined that a thin bladder in the shape of the mandrel 4 can be secured by dipping a counter-form of the mandrel 4 in a liquid bath of latex or similar material. This produces a bladder which fits the mandrel 4 perfectly, and avoids folds and other surface defects. The bladder has an open end that may be connected to a fluid source (not shown) to inflate the bladder through a fluid channel 42 (FIG. 8).

The bladder-covered mandrel 4 is then covered with resin-impregnated fibers, so as to obtain a tube-shaped wound fibrous complex 6. Typically, the pre-impregnated fiber sheets are draped or "layed up" over the bladder-covered mandrel 4 at angles of 0°, or are inclined at different values in relationship to the shaft axis. For example, additional torsional strength can be provided by laying up the bladder-covered mandrel 4 with pre-impregnated fiber plies at an angle of ±45°. Alternatively, the mandrel 4 could also be covered through a filament winding process.

As shown in FIG. 7, the tube 14 is then inserted over the second end 41 of the mandrel 4 in the desired location. It is desirable to maintain the diameter of the resin-impregnated fibers in the tip area to a minimum, to ensure that the tube 14 can fit over the fibrous complex 6 covering the mandrel 4. Typically, the space between the tubular member and the composite is limited to a minimum in order to lower the expansion of the composite during bladder inflation and curing.

Figure 8:
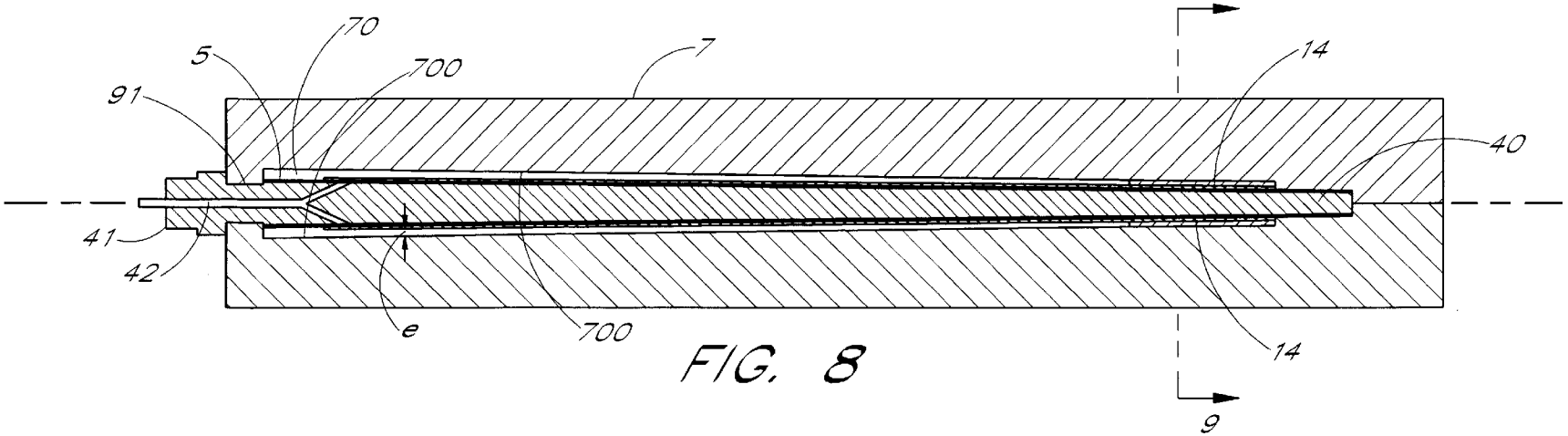
Figure 9:
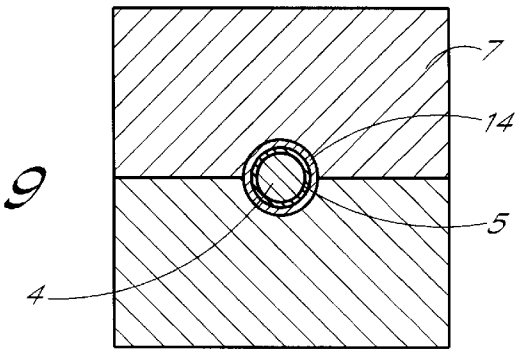

As shown in FIGS. 8 and 9, the subassembly comprising the complex 6, the tube 14 and the bladder-covered mandrel 4 is then placed in a mold 7 having an internal cavity 70 which defines the final shape of the shaft to be produced. Significantly, the cavity 70 of the mold 7 can define a shape that is substantially different and more complex than the tapered shape of the mandrel 4.

The subassembly is positioned so as to preserve a space (e) between the complex composite structure 6 and the surface 700 of the mold 7 which defines the portion of the cavity spaced radially outward from the portion of the complex 6 not covered by the tube 14.

Figure 10:
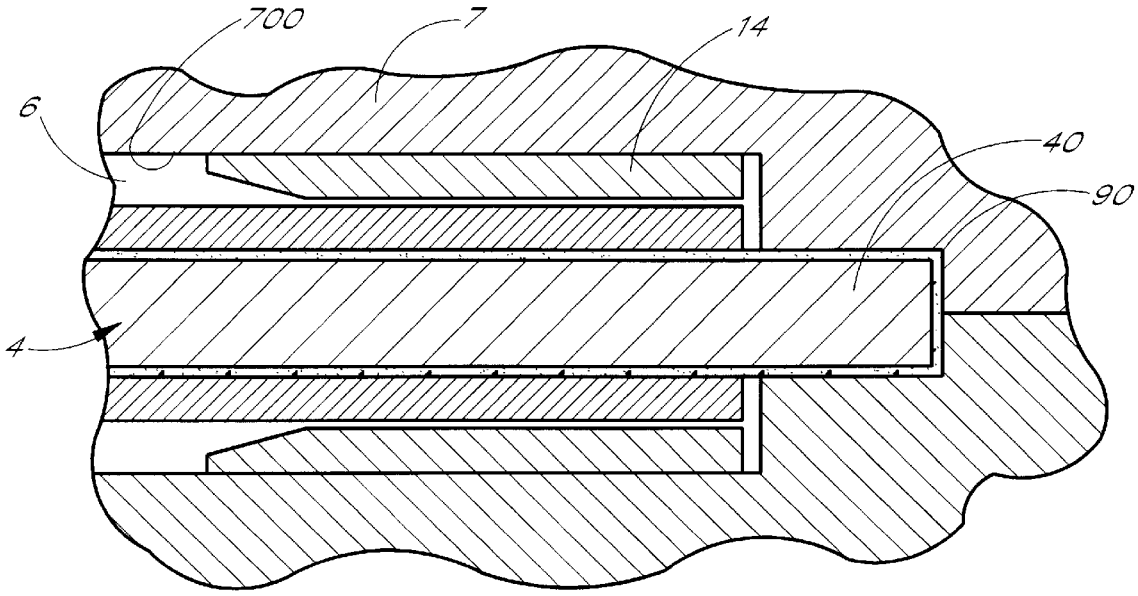

As shown in FIGS. 9 and 10, the tube 14 covers one end of the composite complex 6 and is positioned in a predetermined position in direct contact with the surface of the mold 7. The tube 14 does not move or deform during pressurization. The thin first end 40 of the mandrel 6 is supported in an opening of a complementary shape 90 made in the mold 7. At the second opposite end 41 of the mandrel, the position of the mandrel is maintained by a mold shoulder 91, which holds the mandrel in place, regardless of the length of the mandrel.

Figure 11:
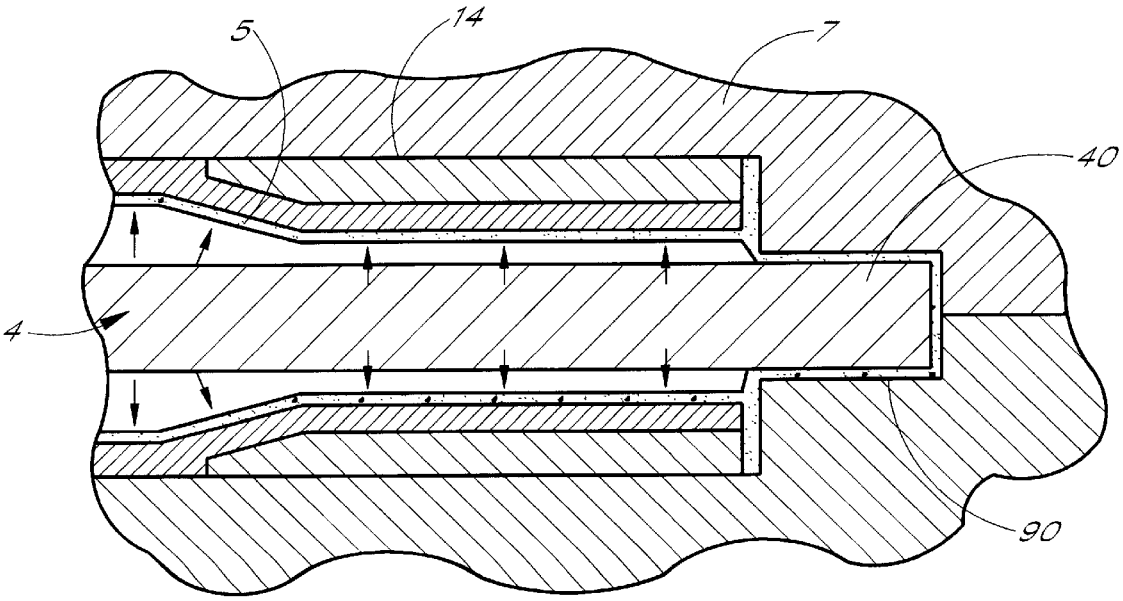

Referring to FIG. 11, the shaft is then molded by heating and applying pressurized fluid inside the bladder 5. The pressurized fluid pushes against the inner surface of the composite complex 6 forcing the exterior surface of the composite complex 6 against the surface 700 of the mold 7 and against the inner surface of the tube 14. During expansion, the portion of the composite complex not surrounded by the tube experiences greater radial displacement than the portion of the composite complex surrounded by the tube. Sufficient pressure is applied to the composite complex that the exterior surface of the composite complex adjacent the tube forms a continuous surface with the external surface of the tube.

The outward movement of the composite complex 6 ensures that the composite complex forms a tight bond with the inner surface of the tube and the upper end of the tube. Significantly, the ramp-shaped upper end of the tube facilitates the ability of the composite complex to form a continuous outer surface with the outer surface of the tube. As a result of this process, the tube 14 is positively maintained in position by the composite complex 6, as a result of the tube being embedded in the resin of the complex.

Significantly, the tubular member is positioned both easily and precisely. The exact longitudinal position of the tube 14 is determined at the time the tube 14 is placed in the mold 7. The molding step itself merely secures the tube 14 in its predetermined position.

Typically, the composite complex 6 is forced outward by means of air which is compressed at about 10–15 bars for a period of approximately 3–4 minutes. The mold is heated for purposes of activating the cross-linking of the thermal hardening resin of the complex 6. Typically, this can be achieved at approximately 150° C. for a duration which will vary, depending upon the type of resin used.

Typically, the subassembly will be heated prior to expansion of the bladder so that the composite complex 6 will soften. This is achieved by heating the mold 7 to a temperature of approximately 145° C. to 155° C. The mold 7 is preferably maintained at a regulated temperature, which is constant during the molding cycle. Pressurization desirably occurs after a short preheating process (e.g., 10–30 seconds) which permits the composite complex to soften, but terminates before the hardening process begins. After preheating, the bladder 5 is pressurized progressively for approximately 60–150 seconds until the bladder reaches a certain stable level of pressure, preferably around 12 bars. Pressure is then maintained at this level for approximately 150–330 seconds.

The bladder 5 is then depressurized, while the composite complex continues to be exposed to heat until roughly 90% of the curing of the composite structure has been achieved.

When 90% of the curing of the composite complex 6 has been achieved, the shaft 10 will be sufficiently hardened so that it can be removed from the mold without being damaged. Altogether, total curing time of the epoxy resin forming the complex 6 will be about 7 minutes. It will be appreciated, however, that the aforementioned time periods will vary, depending upon the nature and reactivity of the resin. Depending upon the nature of the material used to form the bladder 5, and the conditions of the molding cycle, such as temperature and pressure, the bladder 5 will be able to be reused a number of times.

After the shaft 10 is molded, certain cosmetic steps are performed. Specifically, the shaft will be finished, painted, and varnished. Desirably, any burrs of resin located along the mold joint will be removed by grinding. Painting can be followed by a post-curing operation, which entails heating the shaft 10 at a temperature of 80–180° C. for approximately 30 minutes to 2 hours to complete the curing of the shaft and release the volatiles within the composite complex 6.

Alternatively, the method could be performed in other ways. Specifically, the mandrel 5 could be used solely for purposes of forming the composite complex 6, and could be removed prior to the positioning of the composite complex within the mold, thereby diminishing the thermal mass of the mold.

The process could also be modified to incorporate various other molding steps, as described in co-pending U.S. patent application Ser. No. unknown, filed Aug. 15, 1997, and entitled "Golf Shaft With Variable Bladder Thickness" (attorney docket number TMADE.006A), which is hereby incorporated by reference.

Figure 12:
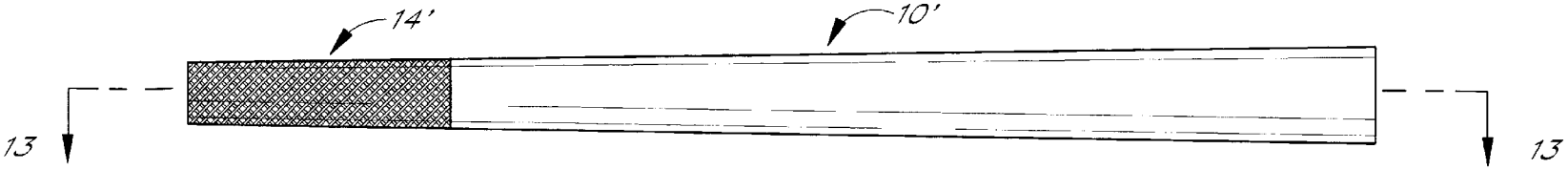
FIG. 12 is a plan view illustrating an alternative golf club shaft of the present invention.
Figure 13A:
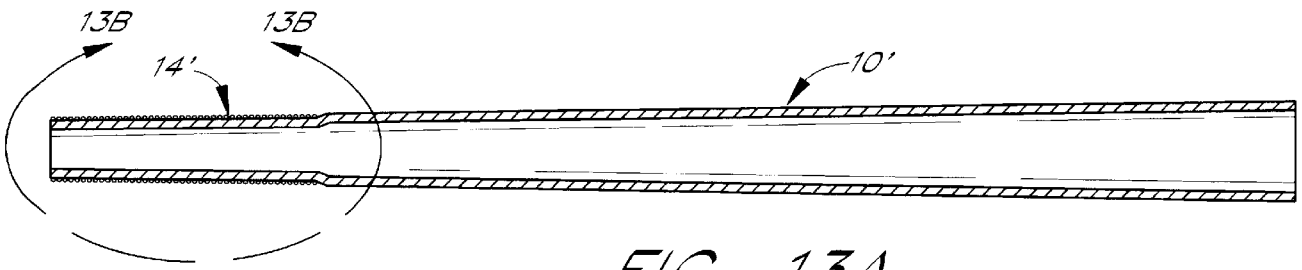
FIG. 13 is a cross-sectional view along 13—13 of FIG. 12.
Figure 13B:
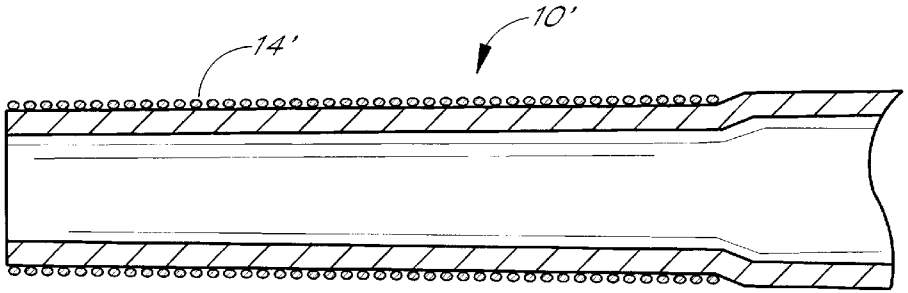

FIGS. 12 and 13 illustrate an alternative shaft 10', which utilizes a tubular metallic sheath 14' comprising a grid or cloth. The sheath 14' may comprise metallic wires arranged at an angle with respect to the longitudinal axis A' of the shaft. The sheath 14' may utilize nonmetallic wires or fibers in a meshed relationship with metallic wires. Depending upon the number and orientation of the metallic wires, the shaft 10' can have mechanical characteristics similar to that of the shaft 10 utilizing the metal tube 14.

Applicant has performed tests to prove the benefits of the above-described shaft and process. Golf club shafts A, B and C has been produced in accordance with the above-described process. Shaft A is the comparative reference. Shaft A comprises a fiber-resin structure with a mass equal to 71.8 grams. It has the following basic characteristics:

it has 6 layers at 0° in the tip region

The layers are G30–500 carbon fiber prepreg with a fiber aerial weight (FAW) of 115 grams per meter squared and an epoxy resin content of 40% by weight It has 4 layers at ±45° in the tip region using G40–600 carbon fiber prepreg with a FAW of 90 grams per square meter and 40% resin content by weight The shaft (B) has the same fiber structure as (A), with a tube of aluminum located over the portion of the composite body proximate the tip end. The aluminum tube has a length of 150 mm and a thickness of 0.5 mm. The Young modulus of the material is approximately 10 Msi. The aluminum tube starts at a distance at 0 mm from the tip end of the shaft to 150 mm from the tip end.

The shaft (C) has the same fiber structure as (A), with an additional lower tubular piece of steel. The length of the steel piece is of 150 mm and the thickness is 0.4 mm. The Young modulus of the material is approximately 30 Msi.

The main characteristics of the three shafts tested are carried to the following table:

| | Mass (in g) | Position CG/butt (in mm) | Inertia (in Kg.mm$^2$) |
|---|---|---|---|
| Reference: | | | |
| (A) | 71.8 | 533 | 7650 |
| Invention: | | | |
| (B) | 78.1 | 568 | 9250 |
| (C) | 85.9 | 615 | 1140 |

In order to determine the torque resistance of each shaft, a measurement test of torsional flexibility is conducted. The method consists of fixing the shaft 102 mm from the butt end and applying a torque of 1 ft-lb at 852 mm from the butt, then measuring the rotational deflection in degrees.

| The results are as following: (in degree) | | |
|---|---|---|
| Reference: | | |
| (A) | 3.5 | |
| Invention: | | |
| (B) | 3.3 | 6% |
| (C) | 3.3 | 6% |

As predicted, a significant improvement of the torque resistance of shafts of the invention (B) and (C) is observed with respect to the reference (A).

The two samples (A) and (B) were also tested on the tip resistance to breakage with cannon. The shafts were mounted in a hosel-like tube attached to a head-like plate. The test comprises impacting the region of the tip of a shaft with balls at predetermined moment values until the breakage of the shaft is obtained. The reference (A) resisted to 1000 shots at 60 Nm and further 72 shots at 72 Nm. The shaft (B) resisted to 1000 shots at 60 Nm and further 600 shots at 72 Nm. It was also noted that the breakage point of the reference shaft (A) occurred at the junction of the hosel-like tube, while it occurred at the upper end of the tubular member for the shaft (B) of the invention.

Figure 14:
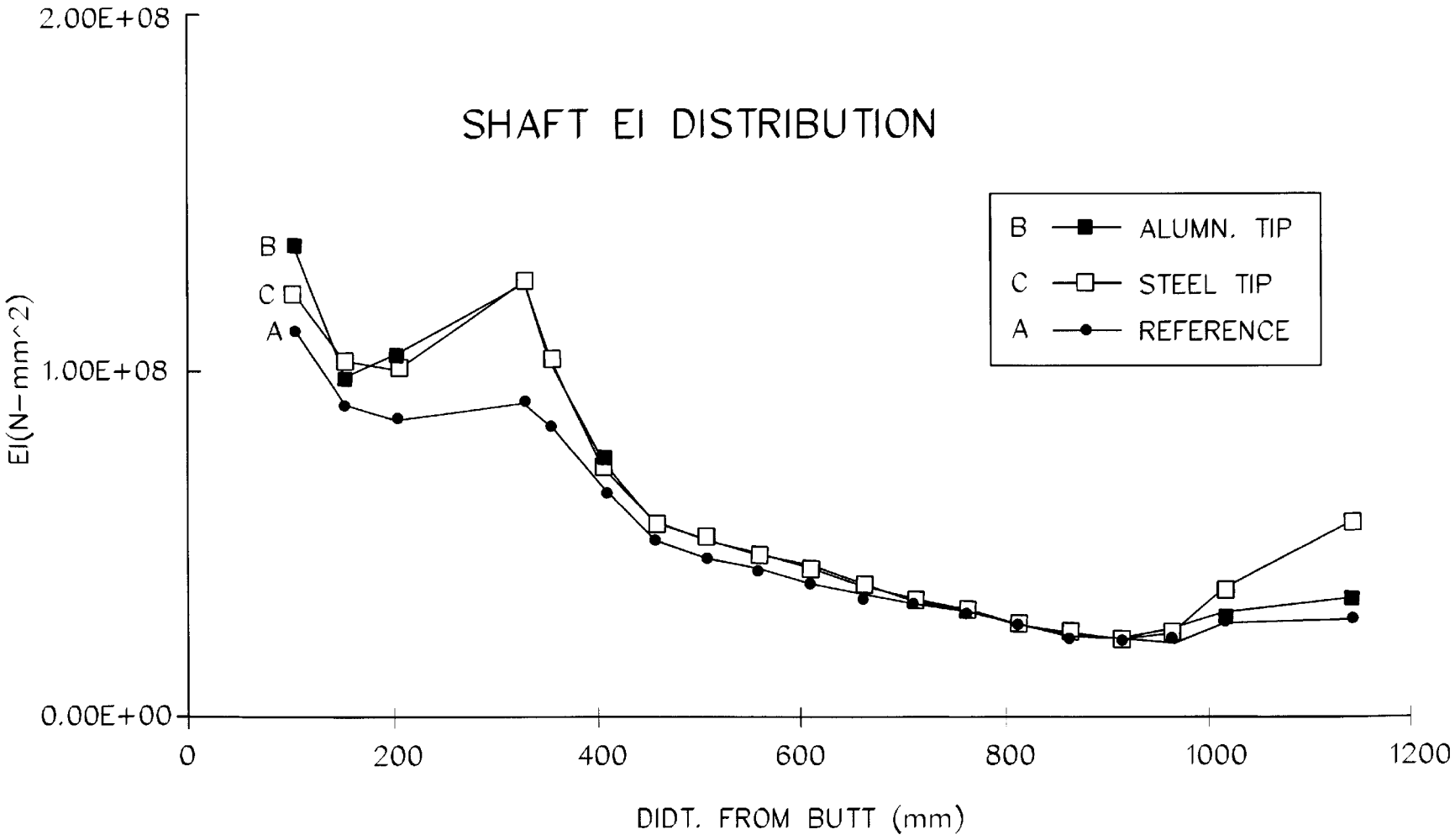
FIG. 14 is a graph of the relationship between flexional rigidity (EI) in $N.mm^2$ along the Y axis and the distance from the butt end of the shaft (L) in mm along the X axis, for three shafts A, B and C.

FIG. 14 shows a graph of the bending rigidity (EI) along the length of the shaft for each of the three samples (A), (B) and (C). An increase of the flexional rigidity in the tip area was observed for the shafts of the invention. The increase was more significant in the case of the steel tube. Player tests have demonstrated that this local effect is particularly appreciated by the high level players.

This local improvement is particularly beneficial when the shaft is combined with an oversized golf club head. Specifically, the shaft of the present invention exhibits less droop effect because of the locally increased flexional rigidity of the lower part of the shaft.

What we claim:

1. A hollow golf club shaft of circular cross section comprising:

a fiber and resin-base hollow body extending substantially the entire length of the shaft from a large butt end to a smaller tip end; and a lower tubular member surrounding said hollow body along a lower covered portion of said hollow body which extends substantially from the tip end to an upper end situated below the median point of the shaft, the remainder of the hollow body constituting a free upper portion of the hollow body, at said upper end, the lower covered portion of said hollow body comprises a short flared portion having an outer surface flaring progressively and locally with respect to the general variation of the hollow body; and said tubular member having complementary locally flared portion comprising an inner surface in engagement which the outer surface of said flared portion of said hollow body.

2. A golf club shaft according to claim 1, wherein at said upper end, a junction between the lower tubular member and the free upper portion of said body is made flush.

3. A golf club shaft according to claim 1, wherein said lower tubular member is cylindrical.

4. A golf club shaft according to claim 1, wherein said lower tubular member is tapered.

5. A golf club shaft according to claim 1, wherein the length of said lower tubular member comprises approximately 0.05 to 0.45 of the total shaft length.

6. A golf club shaft according to claim 1, wherein the thickness $t_1$ of the tubular member is comprised between 0.05 and 0.10 inches; the thickness $t_2$ of the lower covered portion is comprised between 0.01 and 0.13 inches; and the total thickness t of the assembly is comprised between 0.015 and 0.15 inches.

7. A golf club shaft according to claim 1, wherein said hollow body comprises fibers chosen among carbon-graphite, fiberglass, aramid and combination thereof.

8. A golf club shaft according to claim 7, wherein said hollow body comprises a thermosetting or thermoplastic resin.

9. A golf club shaft according to claim 8, wherein said resin is a thermosetting epoxy resin.

10. A golf club shaft according to claim 1, wherein said tubular member is a solid piece of metallic material having isotropic mechanical properties.

11. A golf club shaft according to claim 10, wherein said tubular member is made of a material comprising a member selected from the group consisting of steel, aluminum, aluminum alloy, titanium, titanium alloy, copper, zinc and metal matrix composite.

12. A golf club shaft according to claim 1, wherein said tubular member is a grid or cloth comprising metallic wires arranged in inclination with respect to the longitudinal axis of the shaft.

13. A golf club shaft having a butt end, a tip end and a median point comprising a hollow body comprised of fiber and resin composite extending substantially the length of the shaft from the butt end to the tip end and a tube-shaped stiffener comprising a material other than fiber and resin composite which substantially surrounds the lower portion of the body and extends between the tip end of the body and a point below the median point of the shaft, said tube-shaped stiffener including an upper end, at said upper end the lower covered portion of said hollow body comprises a short flared portion having an outer surface flaring progressively and locally with respect to the general variation of the hollow body; and said tubular member having complementary locally flared portion comprising an inner surface in engagement with the outer surface of said flared portion of said hollow body.

14. The golf club shaft of claim 13, wherein said stiffener is comprised of a material having greater torsional strength per unit of weight than said body.

15. The golf club shaft of claim 14, wherein said material comprises metal.

16. The golf club shaft of claim 15, wherein said stiffener comprises a preformed sheath.

17. The golf club shaft of claim 16, wherein said sheath comprises a metal tube.

18. The golf club shaft of claim 14, wherein said stiffener comprises a preformed sheath.

19. A golf club, comprising:

a golf club head having no hosel and defining an embedding hole extending through a heel of said head from a top surface to a bottom surface of said heel; and a hollow golf club shaft of circular cross section comprising:

a fiber and resin-base hollow body extending substantially the entire length of the shaft from a large butt end to a smaller tip end; and a lower tubular member partially surrounding said hollow body along a lower covered portion of said hollow body which extends substantially from the tip end to an upper end situated below the median point of the shaft, the remainder of the hollow body constituting a free upper portion of the hollow body, wherein a portion of said shaft is positioned within said embedding hole and said tubular member of the shaft extends upward beyond the top surface of said heel of said club head, at said upper end, the lower covered portion of said hollow body comprises a short flared portion having an outer surface flaring progressively and locally with respect to the general variation of the hollow body; and said tubular member having complementary locally flared portion comprising an inner surface in engagement with the outer surface of said flared portion of said hollow body.

* * * * *